US007168405B2

(12) United States Patent
Hartley, Jr.

(10) Patent No.: US 7,168,405 B2
(45) Date of Patent: Jan. 30, 2007

(54) CAMSHAFT DRIVE MECHANISM

(76) Inventor: John J. Hartley, Jr., N24 W30676 Golf Hills Dr., Pewaukee, WI (US) 53072

( * ) Notice: Subject to any disclaimer, the term of this patent is extended or adjusted under 35 U.S.C. 154(b) by 0 days.

(21) Appl. No.: 11/036,741

(22) Filed: Jan. 14, 2005

(65) Prior Publication Data

US 2005/0166878 A1 Aug. 4, 2005

(51) Int. Cl.
*F01L 1/02* (2006.01)

(52) U.S. Cl. ..... 123/90.31; 123/54.4; 123/193.3; 123/193.5; 123/195 AC

(58) Field of Classification Search ..... 123/90.31, 123/90.27, 54.4
See application file for complete search history.

(56) References Cited

U.S. PATENT DOCUMENTS 3,673,990 A * 7/1972 Alfieri ..... 123/54.7
3,738,338 A * 6/1973 Wickman ..... 123/90.27
4,648,359 A 3/1987 Ito
4,658,769 A * 4/1987 Horio et al. ..... 123/90.31
4,716,864 A 1/1988 Binder
4,729,348 A * 3/1988 Okada et al. ..... 123/90.31
5,010,859 A * 4/1991 Ogami et al. ..... 123/195 C
5,014,655 A 5/1991 Ampferer
5,231,961 A 8/1993 Shimada et al.
5,295,459 A 3/1994 Suzuki et al.
5,359,974 A 11/1994 Nonogawa et al.
5,386,808 A 2/1995 Koch
5,735,239 A * 4/1998 Sugano et al. ..... 123/90.31
6,199,525 B1 3/2001 Uema et al.
6,318,321 B1 11/2001 Kensok et al.
6,374,789 B2 * 4/2002 Kawamoto ..... 123/90.31
6,637,398 B2 10/2003 Suzuki et al.
6,640,757 B2 11/2003 Uchida
6,708,652 B2 3/2004 Oki
6,722,323 B2 * 4/2004 Kawamoto ..... 123/54.4
2001/0032607 A1 10/2001 Kitagawa et al.
2003/0037757 A1 2/2003 Osband

FOREIGN PATENT DOCUMENTS

GB 2392476 A * 3/2004

* cited by examiner

*Primary Examiner*—Thomas Denion
*Assistant Examiner*—Kyle M. Riddle
(74) *Attorney, Agent, or Firm*—Jansson, Shupe, Munger & Antaramian, Ltd.

(57) ABSTRACT

Apparatus includes left and right inline type cylinder heads essentially identical to one another and each having an intake side, the left and right cylinder heads being combined into a "V" configuration, so that the two intake sides face one another. A left-head overhead camshaft structure is located in the left head and a right-head overhead camshaft structure is located in the right cylinder head, the overhead camshaft structures being of an end-drive type. A crankshaft is located proximate an apex of the V, the crankshaft having a front-facing end and a rear-facing end, and an offset gear mechanism operates in cooperation with the rear-facing end of the crankshaft for driving the left-head overhead camshaft structure.

9 Claims, 6 Drawing Sheets

10

CAMSHAFT DRIVE MECHANISM

FIELD OF THE INVENTION

The invention relates generally to mechanisms for driving overhead camshafts in internal combustion engines and, more particularly, to driving overhead camshafts in engines formed using at least two identical inline type heads.

BACKGROUND OF THE INVENTION

Inline type motorcycle engines, such as four cylinder, four-stroke engines, are generally known to have high performance and low weight. As a result, a motorcycle having an inline type engine achieves a high power-to-weight ratio, especially when additional weight is shaved from other motorcycle parts including wheels, frame, etc. The engine casings and internal parts of an inline engine are typically optimized for weight savings, within a budget. In general, achieving a lower weight may result in associated higher costs for the same performance level. For example, a racing motorcycle may use titanium, magnesium, and carbon fiber parts that are expensive but that may result in significant weight reduction.

Other types of engines are also used in high performance motorcycles, including V type engines where cylinders are oriented, as the name suggests, in a "V" configuration that includes at least two opposed cylinder banks. V type engines (and inline type engines) are also used in automobiles; however, by comparison with a motorcycle engine, an automobile engine may sacrifice an optimization of power-to-weight ratio due to other considerations such as durability, etc. In the field of V configured internal combustion engines that utilize overhead camshaft(s), a customary practice may include designing the engine so that the intake ports face toward the center of the V and so that the exhaust ports face the outside of the V engine. There are several practical reasons for placing the intake ports in the middle of the V between the two cylinder banks and for placing the exhaust ports on the outside of the engine, for example so that exhaust pipes may be easily attached, etc. This standard V type orientation allows a V type engine, for example, to be efficiently packaged under the hood of an automobile and is a standard configuration for the automobile industry.

Typically, for end-driven camshafts, overhead camshafts of both heads in a V type engine are driven from the "front" of the engine, because the crank at the rear of the engine is too large in diameter to allow for mounting a small pulley used in obtaining a 2:1 reduction ratio required for driving the overhead camshafts. Driving the camshafts for both heads from the front of the engine may cause complications due to the offset required for allowing the camshaft drives to miss one another, and due to a situation where the camshafts in the heads have different lengths and rotate in opposite directions. Due to these and other factors, a typical industry configuration for V configured internal combustion engines utilizes two completely different heads, such as heads with parts orientations that are approximately a mirror image of one another. Other differences between such heads usually includes structural differences related to the above-mentioned offset in camshaft drive.

By using different heads for the opposing sides of a V configured engine, engine manufacturing costs are significantly increased. Such cost increases may be due to extra tooling, dies, fixturing, stocking, etc. Additional costs include those related to extra labor, increases in logistical complexity including additional maintainability/reliability issues, and others. A conventional V type engine design does not provide economy of scale because it does not allow for a use of the head from a single-bank engine (e.g., an inline four cylinder type) on either side of the V when building a V configured engine.

Recently, engines have been manufactured with a V configuration and having overhead camshafts driven from a center portion of the cylinder banks, such as between a second and third cylinder. Other conventional designs have been based on front-drive type camshaft configurations. Such designs have only used front drive and center drive for driving the camshafts. However, these and other conventional V type engine designs are not optimized for driving the camshafts of the opposed heads.

It is important to note that the head(s) of an engine, even those with a camshaft drive in the center, are not perfectly symmetrical. The intake valves and ports are different compared with the exhaust valves and ports. The respective head is "handed." Conventional automotive engines have two different heads, which are mostly the same except that one is "left-handed" and the other is "right-handed." Previous motorcycle engine derived V-8 engines have used center-drive heads, whereby a camshaft drive is configured without adding length to the engine. One advantage to this approach of using direct chain drive of the camshafts, such as by using two sprockets located along the crankshaft, is that this is perhaps the simplest and most inexpensive way to drive the camshafts. As a result, the camshafts of the two heads rotate in a same direction, one camshaft set therefore being rotated in a direction opposite to that originally intended for the head. However, with such conventional engines there are problems with different opening and closing profiles on the cam lobes, a cam chain tensioner being on the wrong side, and other problems undesirably causing the second head to have different parts compared with the first head. Such center-drive configurations are also not easily adapted for increased performance.

Conventionally, there are additional disadvantages pertaining to a use of center-drive type camshaft drive mechanisms. In particular, there has been a conflict between a desire to minimize the size of crankshaft sprockets and the desire to utilize a thick and stiff crankshaft, which has forced engine designers to compromise a given design. Since engines of a type used with a camshaft drive mechanism require a 2:1 drive ratio between the crank and the camshafts, a sprocket on the crankshaft must be half the size of sprockets on the camshaft, for a direct drive. In order to make an engine compact, the sprocket(s) on the camshafts must be as small as possible. In the aforementioned traditional designs, this compromise may result in a very small sprocket being used on the crankshaft, which weakens the crankshaft. This situation has been addressed either by using oversized sprockets on the camshafts or by making the crankshaft very small in diameter in its middle portion. The former requires extra space and the latter creates a weak crankshaft that is subject to harmonics.

Another conventional camshaft drive mechanism has been used in a center-drive type motor, where cams are driven from the front of a V-8 engine to provide a crankshaft that is able to withstand the high torque created in a V-8 configuration. However, such a design requires extra parts and/or custom parts, which makes the design expensive. It may be desirable for racing or similar high performance applications that dictate the use of a stiff crankshaft, but this solution also has the same problem as the other "direct-drive" type designs due to the camshafts of the reversed head being rotated in the wrong direction.

OBJECTS OF THE INVENTION

It is an object of the invention to provide an improved camshaft drive mechanism for overhead camshaft V configured engines overcoming some of the problems and shortcomings of the prior art, including those referred to above.

Another object of the invention is to provide a configuration that uses a same inline type cylinder head for either bank of cylinders in a V type internal combustion engine.

Another object of the invention is to provide a camshaft drive mechanism for overhead camshaft V configured engines that allows the camshaft(s) to be driven from the rear of the engine.

Still another object of the invention is to provide a camshaft drive mechanism for overhead camshaft V configured engines that allows one head having a second bank of cylinders to be reversed with respect to another head having a first bank of cylinders.

Yet another object of the invention is to provide a camshaft drive mechanism for overhead camshaft V configured engines that allows the same relative rotation direction for the camshaft(s) in both heads.

Another object of the invention is to provide a camshaft drive mechanism for overhead camshaft V configured engines that allows the same camshaft(s), even those with different opening and closing profiles, to be used in both heads.

Another object of the invention is to provide a camshaft drive mechanism for overhead camshaft V configured engines that allows the same camshaft drive sprocket(s) to be used in both heads.

Another object of the invention is to provide a camshaft drive mechanism for overhead camshaft V configured engines that allows the slack side of the camshaft chain to face inwardly towards the intake on both heads, whereby the same cam chain tensioning device can be used for the two heads.

Another object of the invention is to provide a camshaft drive mechanism for overhead camshaft V configured engines that allows for a compact design, thereby decreasing the overall length of the engine.

How these and other objects are accomplished will become apparent from the following descriptions and associated drawing figures.

SUMMARY OF THE INVENTION

According to an aspect of the invention, an apparatus includes left and right inline type cylinder heads essentially identical to one another and each having an intake side, the left and right cylinder heads being combined into a "V" configuration, so that the two intake sides face one another, a left-head overhead camshaft structure located in the left head and a right-head overhead camshaft structure located in the right cylinder head, the overhead camshaft structures being of an end-drive type, a crankshaft located proximate an apex of the V, the crankshaft having a front-facing end and a rear-facing end, and an offset gear mechanism in cooperation with the rear-facing end of the crankshaft for driving the left-head overhead camshaft structure.

According to another aspect of the invention, an engine having a front end and a rear end includes a V-block, first and second inline type cylinder heads essentially identical to one another, the first and second cylinder heads being combined into a "V" configuration whereby the first cylinder head is reverse-mounted on the V-block so that a camshaft drive end of the first cylinder head is proximate the rear end of the engine, first and second overhead cam shafts respectively located in the first and second cylinder heads, the first and second overhead camshafts being of a front-drive type, a crankshaft located in the V-block and proximate an apex of the V configured cylinder heads, the crankshaft having a front-facing end and a rear-facing end, an offset gear mechanism in cooperation with the rear-facing end of the crankshaft for driving the first overhead camshaft, and a front drive member attached to the front-facing end of the crankshaft for driving the second overhead camshaft.

According to yet another aspect of the invention, apparatus include a single crankshaft having a front end and a rear end, and having a crankshaft axis, two pairs of camshafts respectively disposed in two essentially identical cylinder heads opposed to one another and disposed in a V-block, a front drive gear rotatably attached to the front end of the crankshaft for driving one of the pairs of camshafts via a first flexible member, and a rear drive gear engaged with the rear end of the crankshaft for driving the other pair of camshafts via a second flexible member, the rear drive gear being offset from the crankshaft axis.

According to a further aspect of the invention, in an engine formed by combining two essentially identical inline type cylinder heads into a "V" configuration to form an overhead camshaft, V configured engine, whereby one of the cylinder heads is reverse-mounted with respect to the other cylinder head, an improvement includes providing a mechanism for driving camshafts of the engine from both the front and the rear of the engine.

According to still another aspect of the invention, a method includes combining two essentially identical inline type cylinder heads into a "V" configuration to form an engine, whereby one of the cylinder heads is reverse-mounted with respect to the other cylinder head, so that a driven camshaft portion of the one cylinder head is proximate a rear end of the engine and a driven camshaft portion of the other cylinder head is proximate a front end of the engine, providing a crankshaft proximate an apex of the two cylinder heads, driving the driven camshaft portion of the one cylinder head with an offset gear being driven by the crankshaft, and driving the driven camshaft portion of the other cylinder head with the crankshaft, whereby the camshaft portions are driven to turn in opposite directions.

According to another aspect of the invention, a method includes combining two essentially identical inline type cylinder heads into a "V" configuration to form an engine, whereby one of the cylinder heads is reverse-mounted with respect to the other cylinder head, so that a driven camshaft portion of the one cylinder head is proximate a rear end of the engine and a driven camshaft portion of the other cylinder head is proximate a front end of the engine, and driving the driven camshaft portions respectively from the rear and front of the engine.

As a result of various implementations of the invention, an improved camshaft driving mechanism overcomes certain problems of the prior art. A mechanism for driving camshafts of an overhead camshaft type V configured engine according to the invention allows driving at least one of the camshafts from the rear of the engine, which allows identical cylinder heads to be used for each bank of cylinders. When a second cylinder head is flipped around so that its intake ports face those of a first cylinder head, the camshaft drive mechanism drives the rear-facing camshaft sprockets of the second cylinder head. The rear face is the end of the engine proximate the flywheel.

The foregoing summary does not limit the invention, which is instead defined by the attached claims.

BRIEF DESCRIPTION OF THE DRAWING FIGURES

DETAILED DESCRIPTION OF PREFERRED EMBODIMENTS

Figure 1:
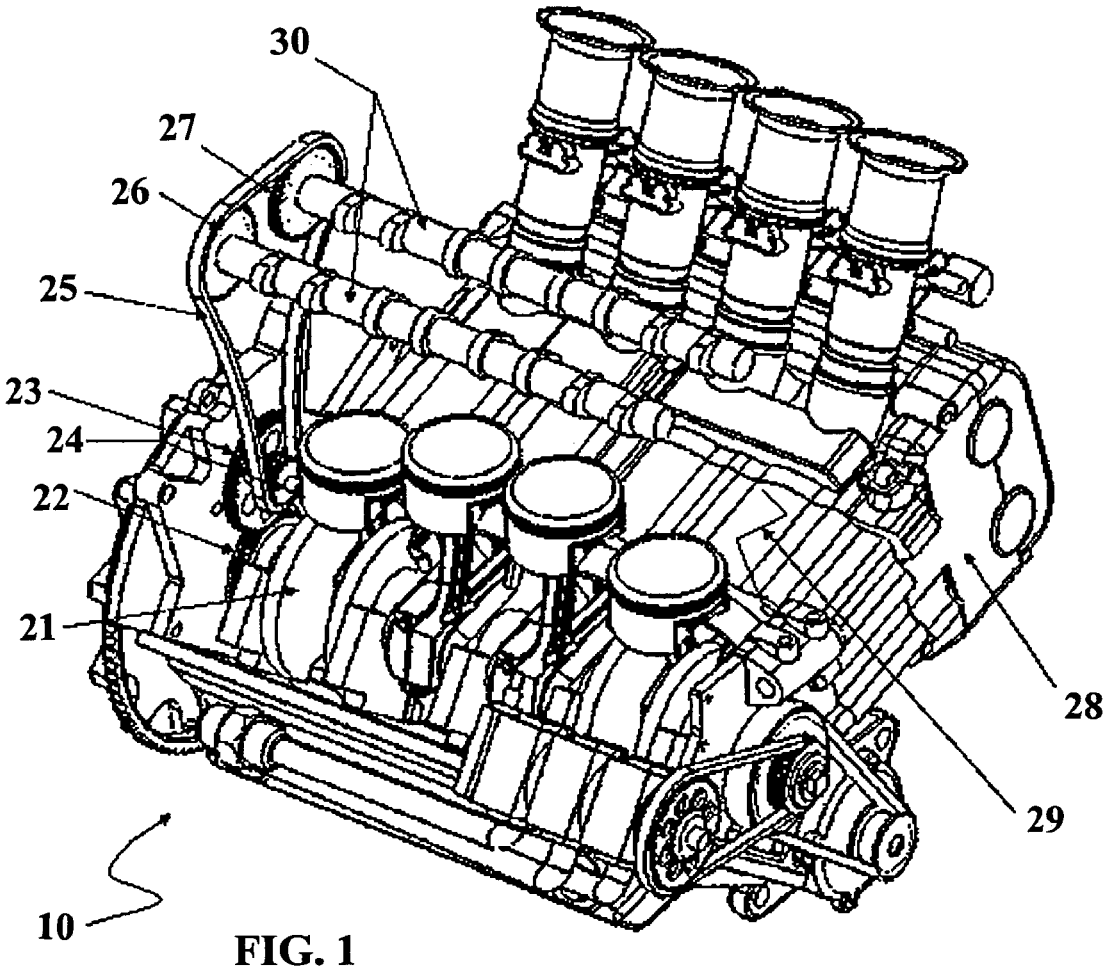
FIG. 1 is an exposed perspective view of an overhead camshaft V-8 engine having a camshaft drive mechanism, according to an exemplary embodiment of the invention.

It is known to combine the heads from two motorcycle engines in order to create a single V-8 engine. This is desirable because motorcycle engines are extremely powerful for their weight. Motorcycle engines generally achieve about twice the horsepower per pound of engine, or about fifty percent more horsepower per cubic inch of displacement when compared to high performance automobile engines. By making a V-8 engine from two separate motorcycle engines, a resultant engine has incredibly high horsepower, and a small size and weight. Such a V-8 engine may be designed for a motorcycle or may be designed for an automobile by using a relatively larger displacement. Conventionally, such a V-8 engine has been achieved by using two motorcycle engines having a camshaft drive that is oriented vertically in the middle of the engine, such as between the second and third cylinder of each inline four cylinder head. Such an orientation may be referred-to as a "center-drive head." For example, U.S. Pat. No. 4,648,359, incorporated herein by reference, discloses cams being driven by a chain from the center of a motorcycle engine, where dual overhead camshafts are provided for each bank of cylinders. As used herein, a crankcase may also be referred to as a "V-block," and an "inline type head" may be considered to have at least three cylinders.

The present inventor has achieved a mechanism for driving camshafts of an overhead camshaft, V configured engine, from both the front and the rear of the engine. This allows identical cylinder heads to be used for each bank of cylinders. For two identical cylinder heads, a second cylinder head is flipped so that the intake ports face the first cylinder head. As a result, the camshaft sprocket(s) of the second cylinder head face the rear of the engine, where they are driven by the mechanism of the invention. It is noted that heads with camshafts that are driven at their ends are used in preferred embodiments of the invention, these being different from the center-drive type heads discussed above. The "end-drive head" is an orientation typically used in newer high performance type motorcycle engines, and it is this type of head that is used in the preferred embodiments described herein. More particularly, an engine manufactured by Suzuki Motor Corporation for a model GSX1300R HAYABUSA motorcycle has a cylinder head with a displacement of 1299 cc and an inline four cylinder configuration with dual overhead end-driven camshafts. Such an engine forms the basis for preferred embodiments of the following examples.

FIGS. 1–3 and FIG. 6 show a V-8 engine 10 of an exemplary preferred embodiment, where a first cylinder head 28 and an identical second cylinder head 29 are mounted on a V block 20. Second cylinder head 29 is reverse mounted on V block 20 so that the camshaft drive end having a camshaft sprocket 26 is at the "rear" of the engine 10, the engine end having the flywheel 32. A camshaft drive mechanism includes a crankshaft gear 22 mounted on or, alternatively, integrally formed with a crankshaft 21, an offset gear 23 set at a distance so as to maintain mesh with the crankshaft gear 22, a sprocket 24 mounted on or integrally formed with offset gear 23, and a chain 25 meshed with and running from offset gear sprocket 24 to camshaft sprockets 26, 27 located on ones of camshafts 30 in cylinder head 29.

While the sprocket and gear sizes are chosen to provide an overall reduction ratio from crank to camshaft(s) of 2:1, as is typically required for a four-stroke engine cycle, it is most desirable for the gears to have a 1:1 ratio, whereby the full reduction ratio of 2:1 is accomplished by the sprocket and chain drive. This provides increased economy and efficiency of manufacturing because the sprocket drive and related parts of second head 29 may be designed to be interchangeable with corresponding parts of first cylinder head 28. In other words, the camshaft(s) of the first cylinder head 28 are preferably driven with a similar chain or timing belt from one small sprocket 43 mounted on crankshaft 21, with a 2:1 ratio also being used for the camshaft sprockets of first cylinder head 28.

Figure 2:
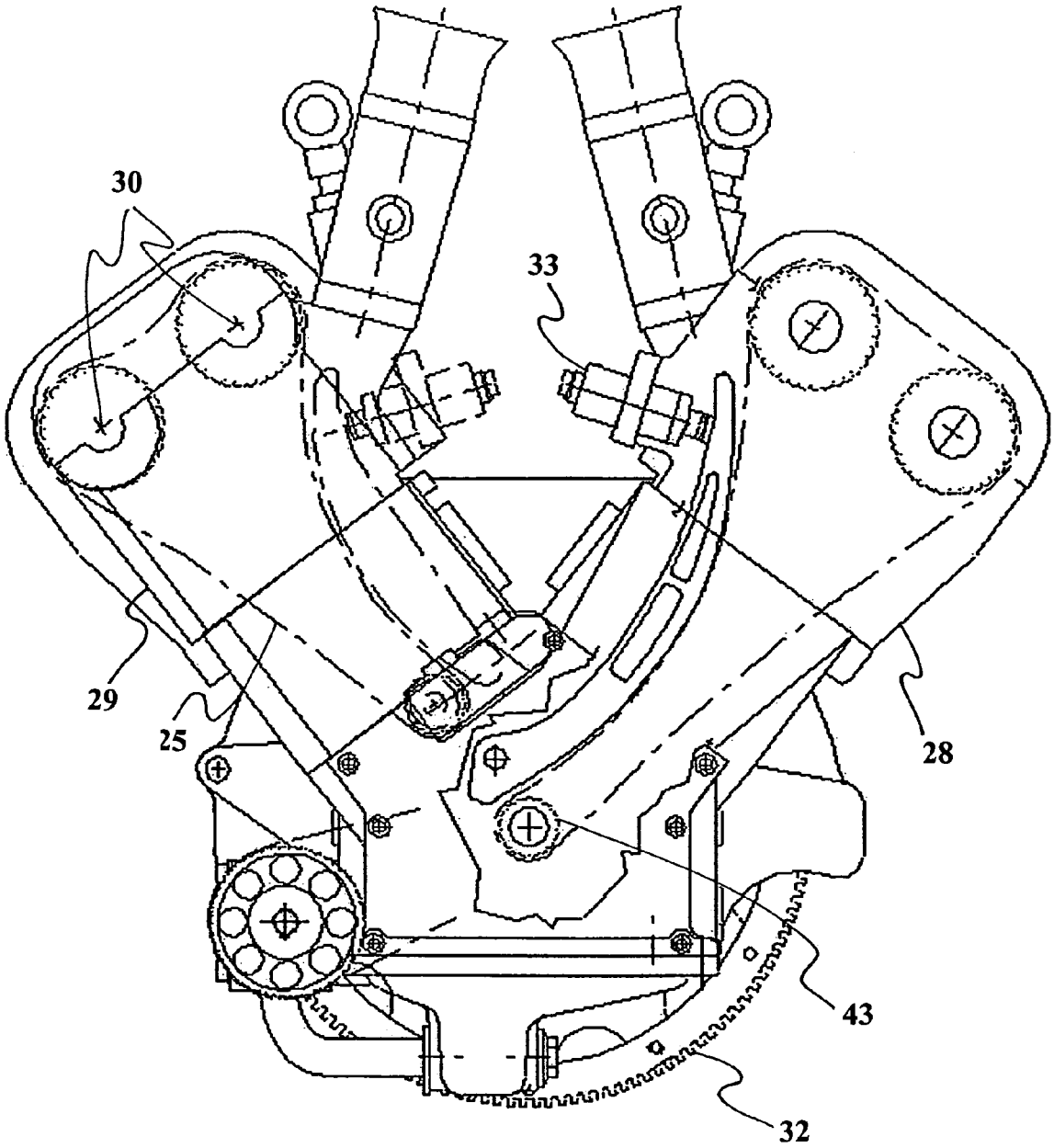
FIG. 2 is a front view of an overhead camshaft V-8 engine having a camshaft drive mechanism, according to an exemplary embodiment of the invention.

FIG. 2 is a front view of overhead camshaft type V-8 engine 10. A conventional camshaft drive mechanism, including sprocket 43 and chain tension adjusting mechanism 33, is used for first cylinder head 28. Identical corresponding parts for the second bank of cylinders include second cylinder head 29, camshafts 30, camshaft sprockets 26, 27, and chain tension adjusting mechanism 34.

Figure 3:
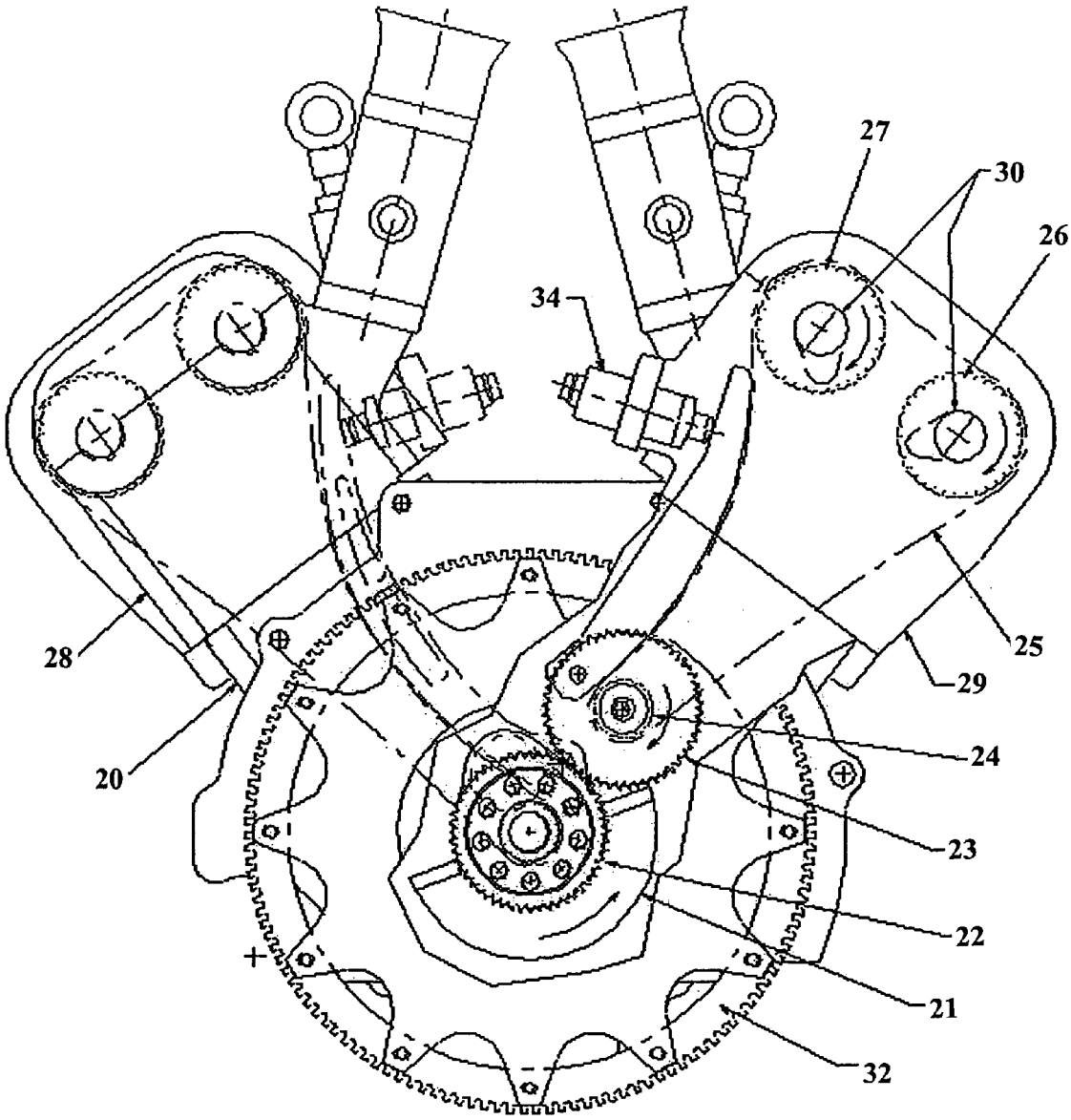
FIG. 3 is an end view of an overhead camshaft V-8 engine having a camshaft drive mechanism, according to an exemplary embodiment of the invention.

FIG. 3 is a rear end view of overhead camshaft type V-8 engine 10. The overhead camshaft drive mechanism for second cylinder head 29 allows cylinder head 29 to be reverse mounted compared with first cylinder head 28. Such camshaft drive mechanism includes crankshaft gear 22, having fifty-two teeth, meshed with a fifty-two tooth offset gear 23. Offset gear 23 is fixedly connected to or integral with seventeen tooth offset sprocket 24, and sprocket 24 is drivingly connected with thirty-four tooth camshaft sprockets 26, 27 via drive chain 25. FIG. 3 also shows the aforementioned conventional end-drive type camshaft drive mechanism of first cylinder head 28.

Figure 4:
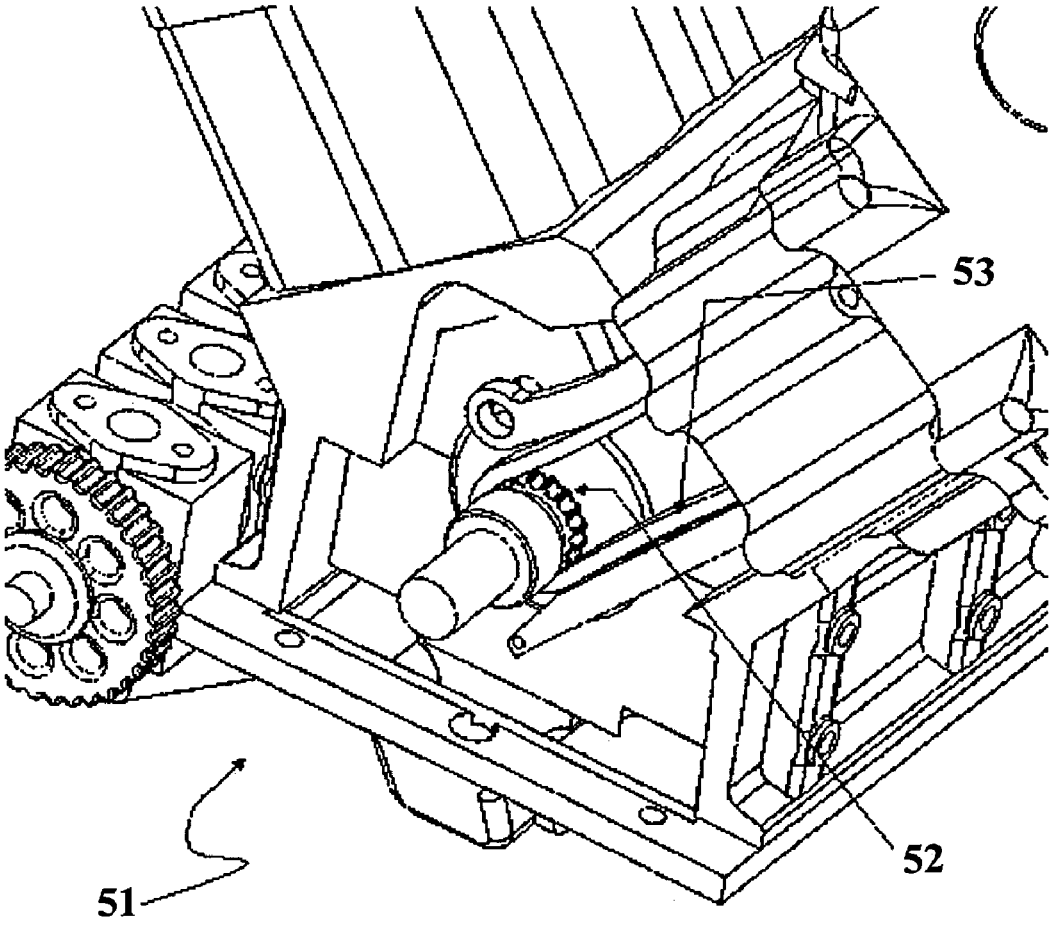
FIG. 4 is a perspective view of the front drive of the engine of FIG. 1, according to an exemplary embodiment of the invention.

FIG. 4 shows an exposed view of the front drive 51. A crankshaft sprocket 52 is mounted to or formed concentrically with the crankshaft 21, and a chain 53 is used for driving the camshafts of head 28.

Figure 5:
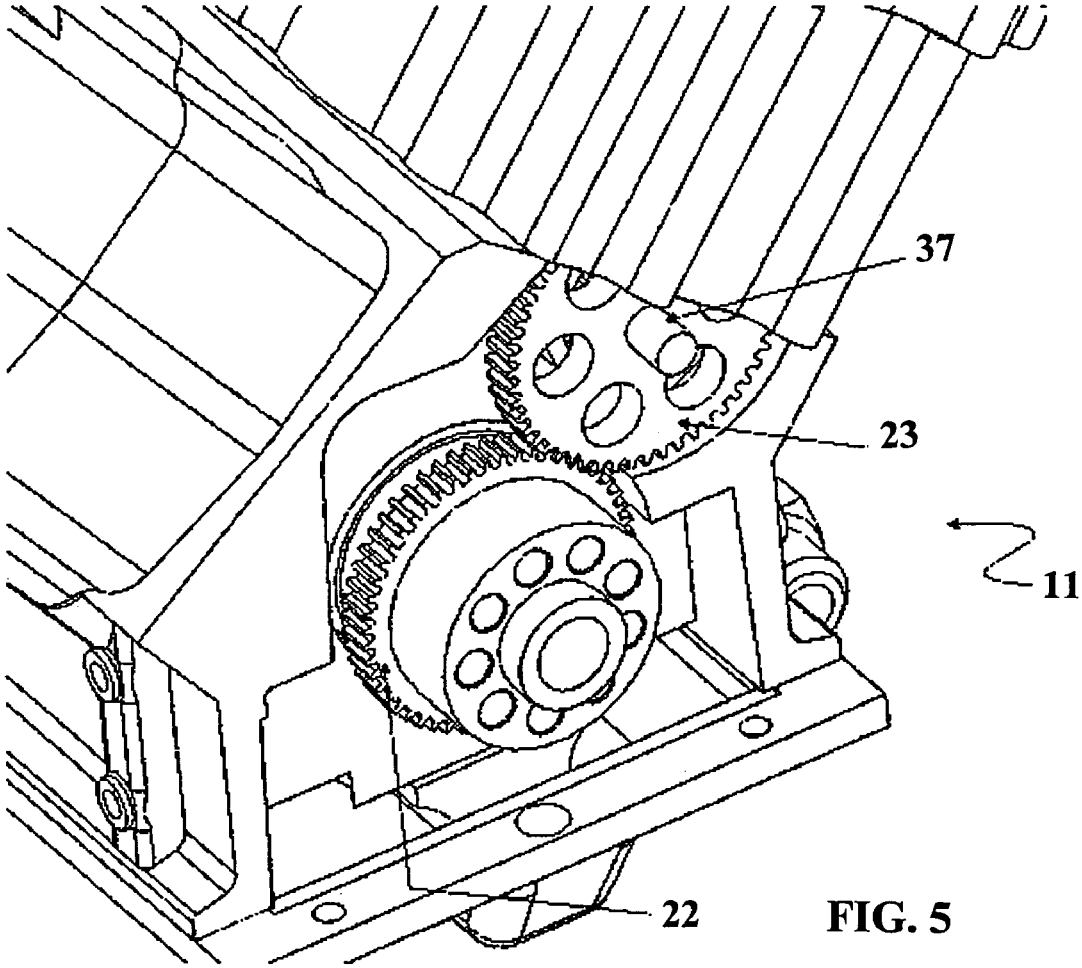
FIG. 5 is a perspective view of the offset gear and drive to the reversed head of the engine of FIG. 1, according to an exemplary embodiment of the invention.
Figure 6:
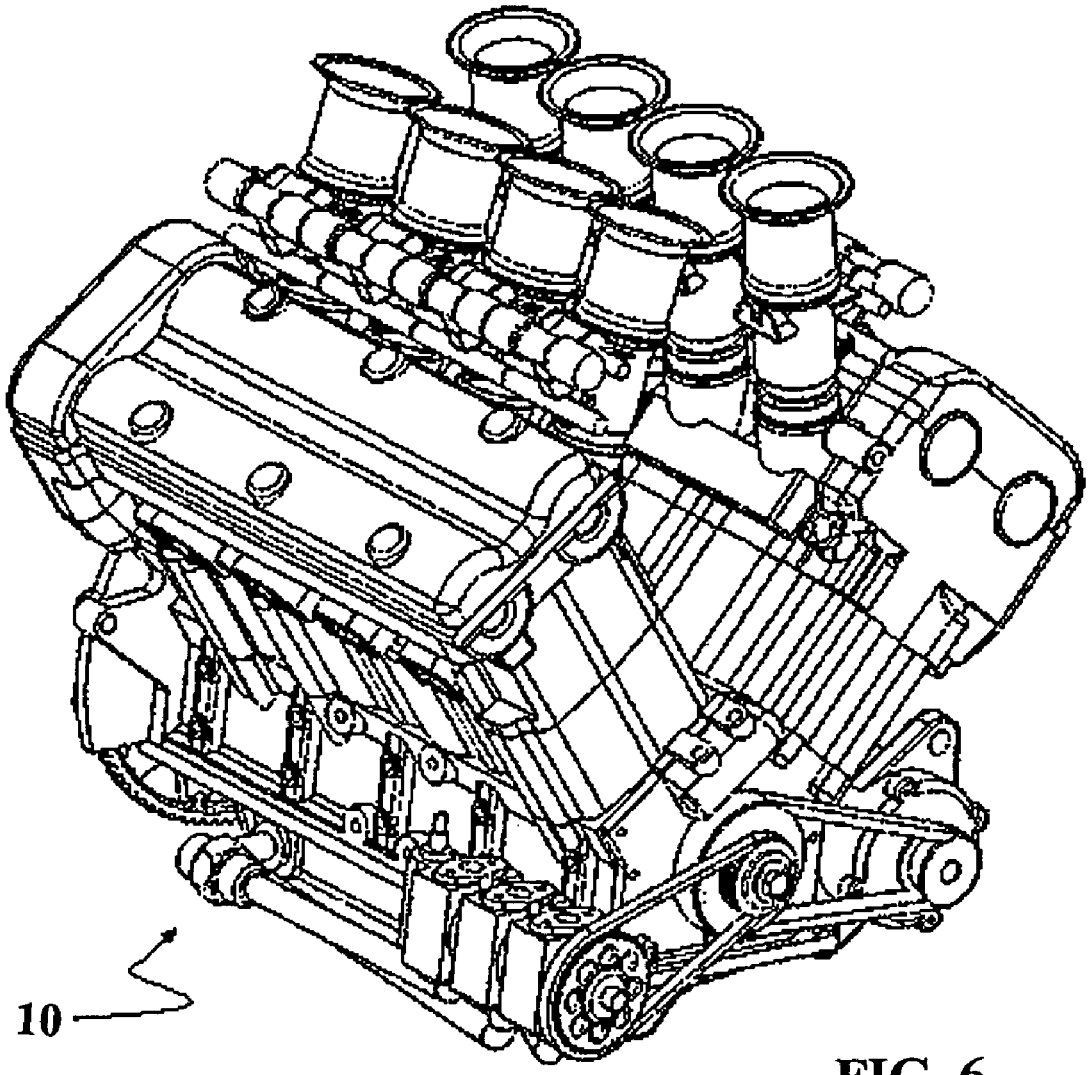
FIG. 6 is a perspective view of an assembled V-8 engine of FIG. 1, according to an exemplary embodiment of the invention.

FIG. 5 shows an exposed view of an offset gear 23 and drive 11. It can be seen that crankshaft gear 22 is meshed with offset gear 23. A sprocket 24 is then attached to the spindle 37 for driving camshafts 30 via chain 25.

In an overhead camshaft type engine, the lobes on the camshafts open and close the valves of the engine with a very carefully controlled profile, so that the valves are positioned for obtaining maximum power. Such camshaft lobes generally are non-symmetrical. The half of a lobe that opens the valve has a different profile compared with the half of the lobe that closes the valve. If the corresponding camshaft were to be driven in a manner so that it rotates in a direction opposite to the intended direction, the profile intended for closing the valve would open the valve, and the profile intended for opening the valve would close the valve. Such would result in an engine having less power. Therefore, it is important that the camshafts of each engine head be rotated in the same direction as that which was originally intended. The camshaft drive mechanism of the present invention achieves this intended implementation of camshaft lobe profiles for both heads by rotating the camshafts in the intended directions. In the example shown in the drawing figures, the camshafts of head 28 are driven in an opposite direction compared with the camshafts of reverse-mounted head 29, whereby the intended camshaft rotations are maintained and the original camshafts are preferably used.

By comparison, it is also possible to drive the camshafts of both heads 28, 29 in the same direction. In such a case, custom camshafts having reversed profiles would be required for achieving the same power output. The present invention avoids such a need for different camshafts for the two heads 28, 29 by rotating the camshafts in the same direction as originally intended; in the present example, camshafts of heads 28, 29 are rotated in opposite directions with respect to one another.

As four cylinder sportbike engines have become bigger and more powerful, the compromises associated with a center-drive type head have caused a design change for such engines. Larger displacement engines have less room for the large bulging sprockets previously used inside a valve cover. The increased torque of such engines proscribed the use of a small sprocket in the center of the correspondingly weakened crankshaft. In recent years, these high performance engines have replaced the center-drive configuration with a "front-drive" head design that allows for a use of small sprockets together with a thick, stiff crankshaft. A very small sprocket can be used on the end of the crankshaft with a front-drive configuration. The corresponding camshaft sprockets can also be relatively small. A four cylinder HAYABUSA engine uses a direct chain drive between the crankshaft sprocket and the camshaft sprockets. For example, this engine uses a very small seventeen tooth sprocket having a pitch diameter of only about 1.375 inches.

The use of two HAYABUSA heads to make a V-8 engine is more complex. The cams for one head are driven in the conventional manner from the small end of the crank using the direct drive sprocket. The reversed head 28, however, has its camshaft sprockets 26, 27 facing the rear of the engine 10. The rear end of crankshaft 21 bolts to the flywheel 32 and is larger in diameter than the front of the crankshaft 21 in order to handle the increased torque being transmitted to the transmission. If the rear end of crankshaft 21 were used in a same manner as its front end for directly driving a camshaft, a much larger sprocket would be required on crankshaft 21. Typically, a corresponding camshaft sprocket would be required to be twice as large as a front-end sprocket to maintain the aforementioned 2:1 ratio. This would be undesirable because of the extra space and extra modification of the head. The present inventor has addressed this problem by using reversed head 29 with offset gear 23, whereby no modifications of the heads or camshafts are required, and where the drive mechanism is compact and simple.

Other uses of the disclosed camshaft drive mechanism include, for example, engines having various configurations such as those with banks of cylinders oriented at one hundred eighty degrees with respect to one another, inline engines having a single bank of cylinders, etc.

For example, suitable engines that may be adapted for use with the present camshaft drive mechanism may include those disclosed in U.S. Pat. Nos. 5,386,808, 5,295,459, 6,199,525, 4,716,864, 5,014,655, 5,231,961, and others. These listed U.S. Patents are each incorporated herein by reference. None of these conventional designs uses two reversed identical heads with a rear-drive type camshaft driving mechanism having an offset gear.

The present invention combines a camshaft drive mechanism having an offset gear for driving a rear end of one set of camshafts and a front camshaft drive mechanism for driving another set of camshafts, the sets of camshafts being for reversed identical cylinder heads.

While the principles of the invention have been shown and described in connection with specific embodiments, it is to be understood that such embodiments are by way of example and are not limiting. Consequently, variations and modifications commensurate with the above teachings, and with the skill and knowledge of the relevant art, are within the scope of the present invention. The embodiments described herein are intended to illustrate best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. Apparatus comprising:

left and right inline type cylinder heads essentially identical to one another such that left cylinder heads are interchangeable with right cylinder heads and each having an intake side, the left and right cylinder heads being combined into a "V" configuration, so that the two intake sides face one another;

a left-head overhead camshaft structure located in the left head and a right-head overhead camshaft structure located in the right cylinder head, the overhead camshaft structures being of an end-drive type, the left-head and right-head overhead camshaft structures each including a pair of camshafts, each camshaft of the left-head overhead camshaft structure including a camshaft sprocket that is at least one of concentrically mounted to and integral with the respective overhead camshaft, the camshafts of the left-head overhead camshaft structure having the identical profile as the camshafts of the right-head overhead camshaft structure such that the camshafts of the respective overhead camshaft structures are interchangeable, the camshafts of the left-head overhead camshaft structure rotating in an direction opposite to a rotational direction of cams in the right-head overhead camshaft structure;

a crankshaft located proximate an apex of the V, the crankshaft having a front-facing end and a rear-facing end;

an offset gear mechanism in cooperation with the rear-facing end of the crankshaft for driving the left-head overhead camshaft structure, the offset gear mechanism including a crankshaft gear disposed proximate the rear-facing end of the crankshaft, the crankshaft gear being one of mounted to and integral with the crankshaft, including an offset gear mounted to maintain mesh with the crankshaft gear, and including an offset gear drive sprocket that is one of concentrically mounted to and integral with the offset gear;

a chain engaged with the left-head camshaft sprockets and with the offset gear drive sprocket for transferring a drive force of the crankshaft to the pair of left-head overhead camshafts, wherein sizes of the camshaft sprockets, drive sprocket, crankshaft gear, and offset gear are chosen to provide an overall rotation reduction ratio from crankshaft to camshaft of 2:1, and wherein a gear ratio of the crankshaft gear to the offset gear is approximately 1:1;

a non-offset gear mechanism in cooperation with the front-facing end of the crankshaft for driving the right-head overhead camshaft structure, the non-offset gear mechanism including a second crankshaft gear and second crankshaft gear sprocket; and a second chain engaged with the right-head camshaft sprockets and with the crankshaft gear sprocket of the non-offset gear mechanism for transferring a drive force of the crankshaft to the pair of right-head overhead camshafts.

2. Apparatus of claim 1, wherein the left and right inline type cylinder heads each have three cylinders, so that the combined heads effect a V-6 type engine.

3. Apparatus of claim 1 wherein the left and right inline type cylinder heads each have four cylinders, so that the combined heads effect a V-8 type engine.

4. Apparatus of claim 1 wherein the left and right inline type cylinder heads each have five cylinders, so that the combined heads effect a V-10 type engine.

5. Apparatus of claim 1 wherein the left and right inline type cylinder heads each have six cylinders, so that the combined heads effect a V-12 type engine.

6. Apparatus of claim 1, further comprising:

a left-side chain disposed about the crankshaft and about the left-head overhead camshaft structure for driving the left-head overhead camshaft structure;

a right-side chain disposed about the crankshaft and about the right-head overhead camshaft structure for driving the right-head overhead camshaft structure; and wherein a slack side of each of the left-side and right-side chains face one another.

7. Apparatus of claim 6 further comprising left and right tensioning devices for respectively controlling tension of the left-side chain and right-side chain.

8. Apparatus of claim 7 wherein the left and right tensioning devices independently control tensions of the respective chains.

9. Apparatus of claim 7 wherein the left and right tensioning devices are essentially identical and interchangeable.

* * * * *

UNITED STATES PATENT AND TRADEMARK OFFICE

CERTIFICATE OF CORRECTION

PATENT NO. : 7,168,405 B2
APPLICATION NO. : 11/036741
DATED : January 30, 2007
INVENTOR(S) : John J. Hartley, Jr.

It is certified that error appears in the above-identified patent and that said Letters Patent is hereby corrected as shown below:

Add:

--RELATED U.S. APPLICATION DATA
Provisional application No. 60/540,168, filed on January 30, 2004.--

Claim 1:

Column 8, line 36, delete "heads are" and insert --head is--.
Column 8, line 37, delete "heads" and insert --head--.
Column 8, beginning at line 46, delete "of the left-head overhead camshaft structure".
Column 8, beginning at line 56, delete "cams in" and insert --camshafts of--.
Column 9, line 3, after "gear" insert --, wherein a gear ratio of the crankshaft gear to the offset gear is approximately 1:1;--.
Column 9, line 4 after "a" insert --left-side--.
Column 9, line 7, after "camshafts" insert --;--.
Column 9, beginning at line 8, delete "wherein sizes of the camshaft sprockets, drive sprocket, crankshaft gear, and offset gear are chosen to provide an overall rotation reduction ratio from crankshaft to camshaft of 2:1, and wherein a gear ratio of the crankshaft gear to the offset gear is 1:1.".
Column 9, line 17, delete "second".
Column 9, beginning at line 17, delete "gear and second crankshaft gear".
Column 9, beginning at line 19, delete "a second chain engaged with the right-head camshaft sprockets and with the crankshaft gear sprocket of the non-offset gear mechanism for transferring a drive force of the crankshaft to the pair of right-head over-head camshafts" and insert --a right-side chain engaged with the right-head camshaft sprockets and with the crankshaft sprocket for transferring a drive force of the crankshaft to the pair of right-head overhead camshafts, wherein sizes of the camshaft sprockets, offset gear drive sprocket, crankshaft sprocket, crankshaft gear, and offset gear are chosen to provide an overall rotation reduction ratio from crankshaft to each camshaft of 2:1.--.

Claim 6:

Column 10, line 7, delete "further comprising:" and insert --wherein,--.
Column 10, line 8, delete "a" and insert --the--.
Column 10, line 8, after "chain" insert --is--.
Column 10, line 8, delete "crankshaft" and insert --offset gear drive sprocket--.
Column 10, line 10, after "structure" insert --, the left-side chain having a slack side; and--.

UNITED STATES PATENT AND TRADEMARK OFFICE

CERTIFICATE OF CORRECTION

PATENT NO. : 7,168,405 B2
APPLICATION NO. : 11/036741
DATED : January 30, 2007
INVENTOR(S) : John J. Hartley, Jr.

It is certified that error appears in the above-identified patent and that said Letters Patent is hereby corrected as shown below:

Claim 6 (cont'd):

Column 10, line 11, delete "a" and insert --the--.
Column 10, line 11, after "chain" insert --is--.
Column 10, line 11, after "crankshaft" insert --sprocket--.
Column 10, line 13, after "structure" delete "; and".
Column 10, line 13, after "structure" insert --, the right-side chain having a slack side,--.
Column 10, line 13, delete "a" and insert --the--.
Column 10, line 13, delete "side" and insert --sides--.

Signed and Sealed this

Fourteenth Day of August, 2007

JON W. DUDAS
*Director of the United States Patent and Trademark Office*